US007063568B2

(12) United States Patent
Ko

(10) Patent No.: US 7,063,568 B2
(45) Date of Patent: Jun. 20, 2006

(54) LOW PROFILE ELECTRICAL CONNECTOR

(75) Inventor: David (Tso-Chin) Ko, Fullerton, CA (US)

(73) Assignee: Hon Hai Precision Ind. Co., Ltd., Taipen Hsien (TW)

( * ) Notice: Subject to any disclaimer, the term of this patent is extended or adjusted under 35 U.S.C. 154(b) by 4 days.

(21) Appl. No.: 10/735,154

(22) Filed: Dec. 11, 2003

(65) Prior Publication Data

US 2005/0130494 A1 Jun. 16, 2005

(51) Int. Cl.
*H01R 13/648* (2006.01)

(52) U.S. Cl. ..... 439/607; 439/353

(58) Field of Classification Search ..... 439/607–610, 439/660, 492–495, 79, 571–573, 629, 108, 439/901, 353
See application file for complete search history.

(56) References Cited

U.S. PATENT DOCUMENTS

| | | | | |
|---|---|---|---|---|
| 6,077,115 | A * | 6/2000 | Yang et al. | 439/567 |
| 6,193,552 | B1 * | 2/2001 | Chiou et al. | 439/607 |
| 6,267,623 | B1 | 7/2001 | Hisamatsu | |
| 6,273,753 | B1 * | 8/2001 | Ko | 439/579 |
| D457,138 | S | 5/2002 | Igarashi | |
| 6,619,985 | B1 * | 9/2003 | Ko | 439/607 |
| 6,648,668 | B1 * | 11/2003 | Ko | 439/353 |
| 6,811,439 | B1 * | 11/2004 | Shin-Ting | 439/607 |
| 6,821,158 | B1 * | 11/2004 | Iida et al. | 439/660 |

* cited by examiner

*Primary Examiner*—P. Austin Bradley
*Assistant Examiner*—Edwin A. Leon
(74) *Attorney, Agent, or Firm*—Wei Te Chung

(57) ABSTRACT

An electrical connector (1) includes an insulative housing (10) defining a first and a second mating ports (140, 125) at opposite sides thereof, a number of contacts (20) received in the insulative housing and each having a first contact portion (22) exposed into the first mating port and a second contact portion (25) exposed into the second mating port, and a shield member (30) attached to the insulative housing.

1 Claim, 9 Drawing Sheets

LOW PROFILE ELECTRICAL CONNECTOR

BACKGROUND OF THE INVENTION

1. Field of the Invention

The present invention relates to an electrical connector, and particularly to an electrical connector having a low profile.

2. Description of Related Art

Most notebook computers come with slots for PC cards, and the consumers are quite familiar with them. While PC central processing unit (CPU) clock frequencies are rising along with the speeds of peripheral technologies like PCI Express and Gigabit Ethernet, the PC Card standard would not be able to handle developing applications smoothly. A new specification named NEWCARD will take the next generation in PC Card evolution. In addition to the successful characteristics of the PC Card: reliability, ease of use and wide industry support while delivering external expansion with reduced size, higher speed, lower costs and support of advanced serial I/O technologies, USB 2.0 and PCI Express, the new specification offers key advantages in terms of faster speed and smaller size. So, devices which connect the NEWCARDs and the PCI Express interfaces in the notebooks must be low profile interconnection and also meet the signal integrity requirement of PCI Express in the notebook application.

SUMMARY OF THE INVENTION

An object of the present invention is to provide an electrical connector having a low profile.

To achieve the above object, an electrical connector in accordance with the present invention comprises an insulative housing defining a first and a second mating ports at a front and a rear sides thereof, a plurality of contacts received in the insulative housing and each having a first contact portion exposed into the first mating port and a second contact portion exposed into the second mating port, and a shield member attached to the insulative housing.

Other objects, advantages and novel features of the invention will become more apparent from the following detailed description when taken in conjunction with the accompanying drawings.

DETAILED DESCRIPTION OF THE INVENTION

Figure 1:
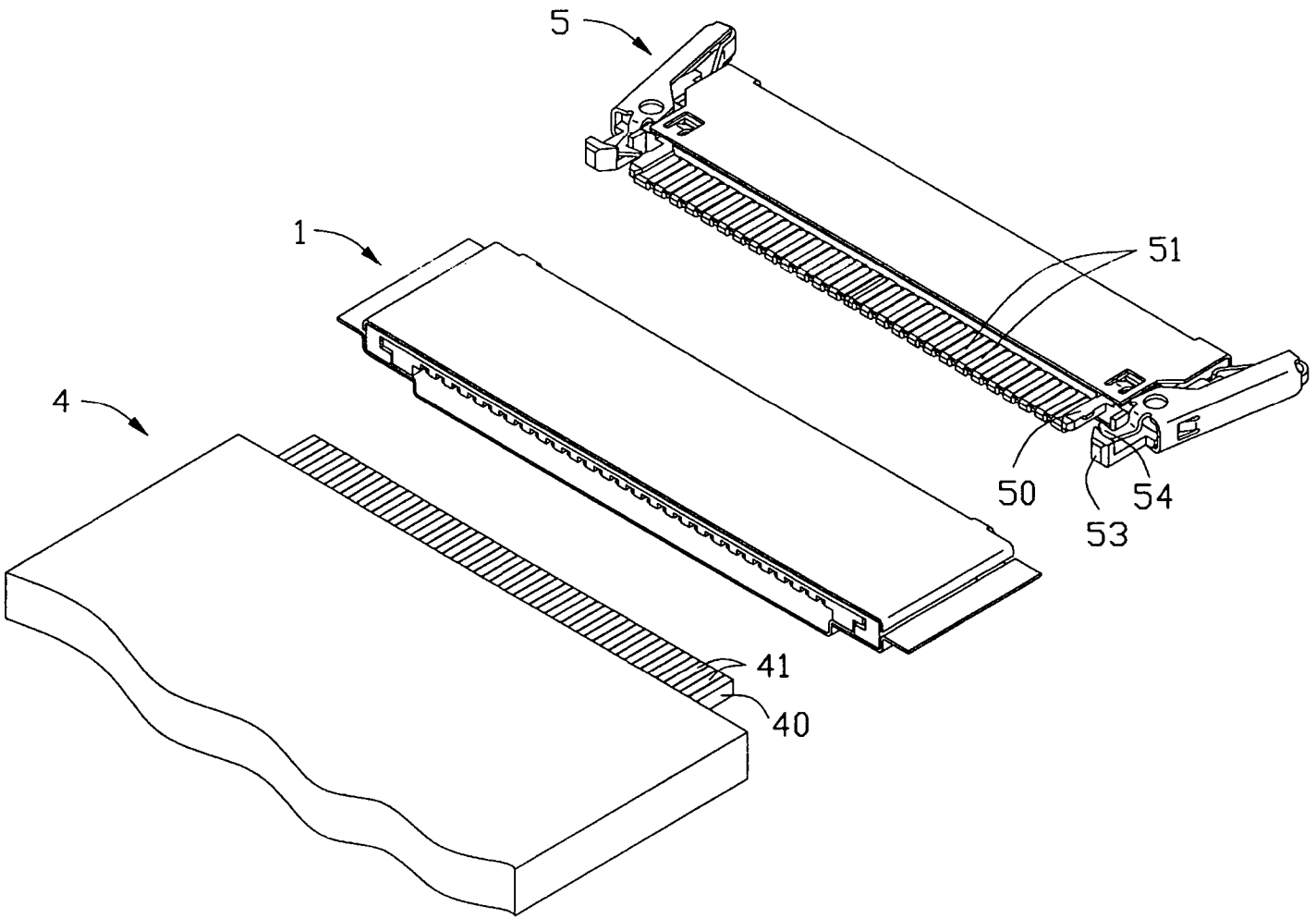
FIG. 1 is a perspective view of an electrical connector in accordance with the present invention, and a module and a complementary connector for mating with the electrical connector.
Figure 2:
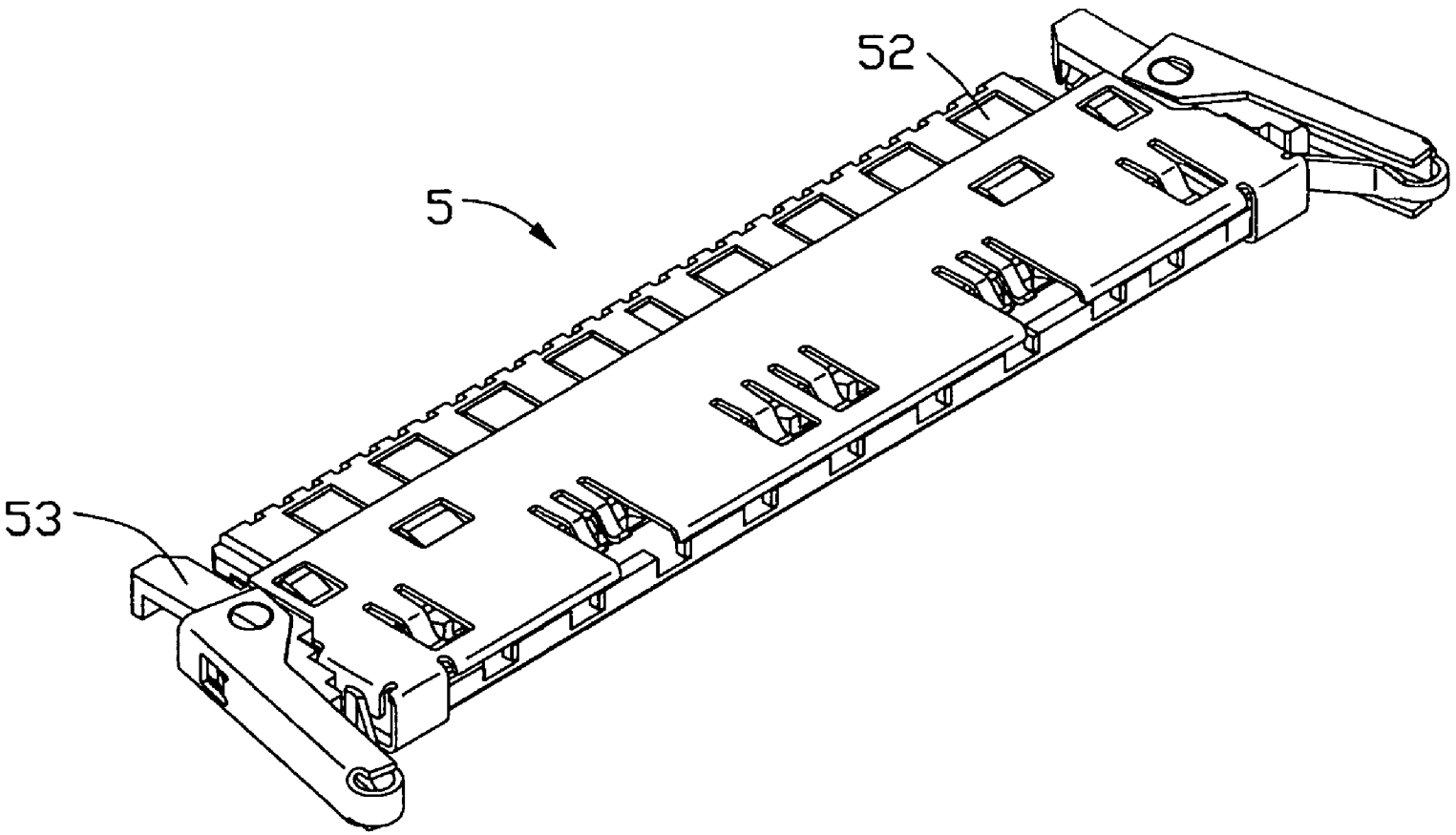
FIG. 2 is a perspective view of the complementary connector of FIG. 1 but taken from another aspect.
Figure 3:
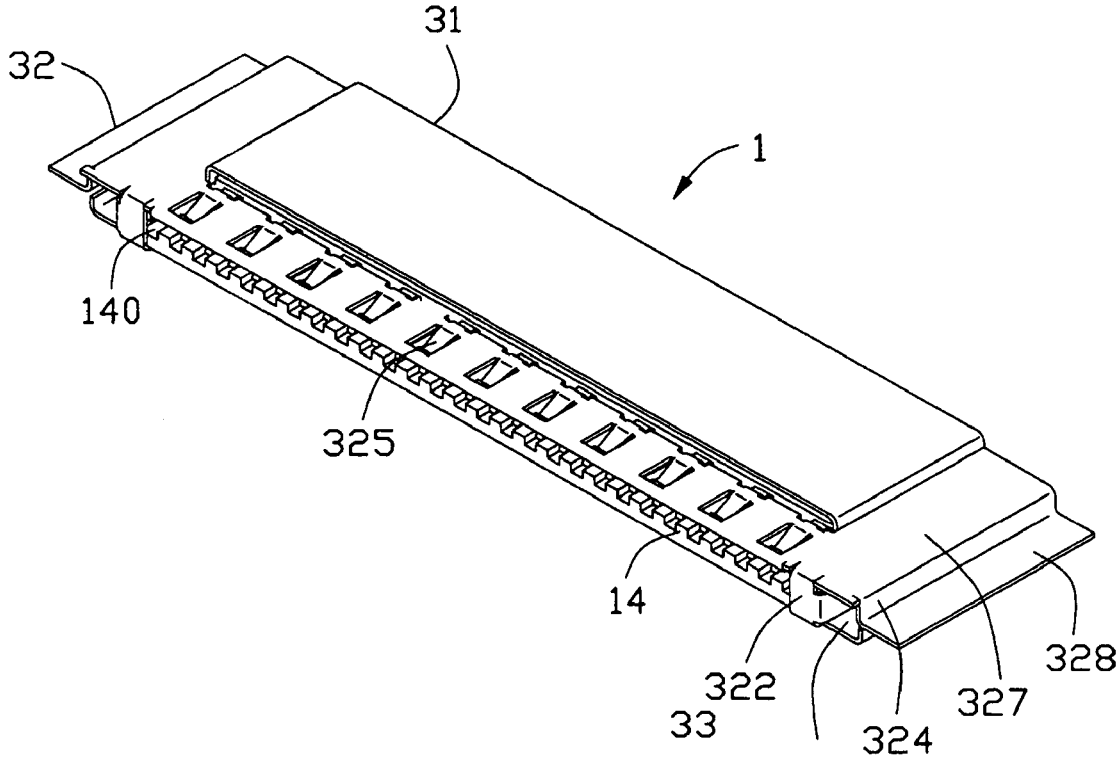
FIG. 3 is a perspective view of the electrical connector of FIG. 1 but taken from another aspect.
Figure 4:
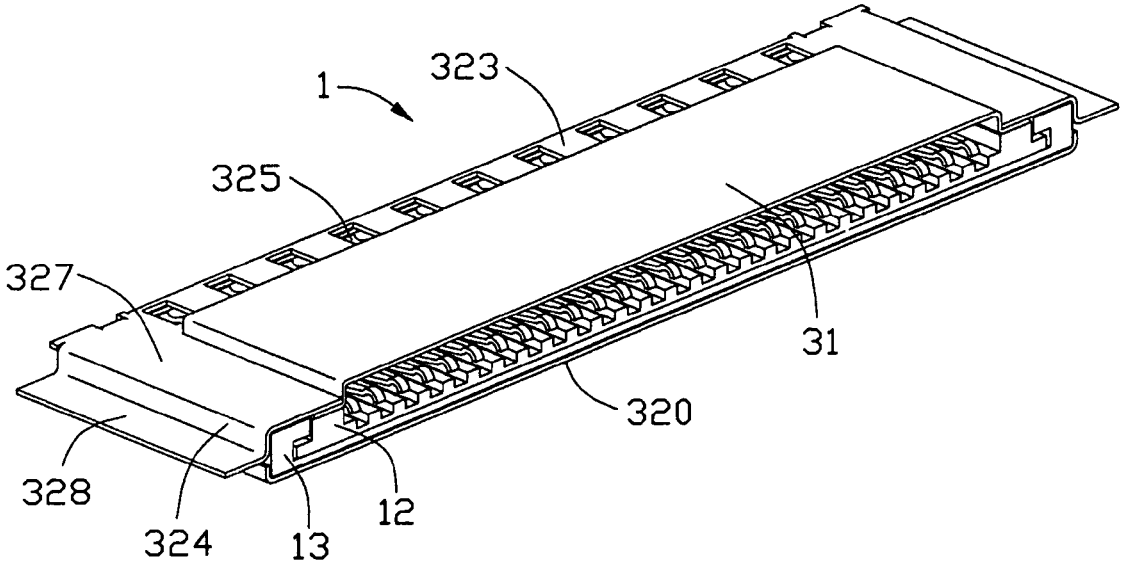
FIG. 4 is a perspective view of the electrical connector of FIG. 1 but taken from another aspect.
Figure 5:
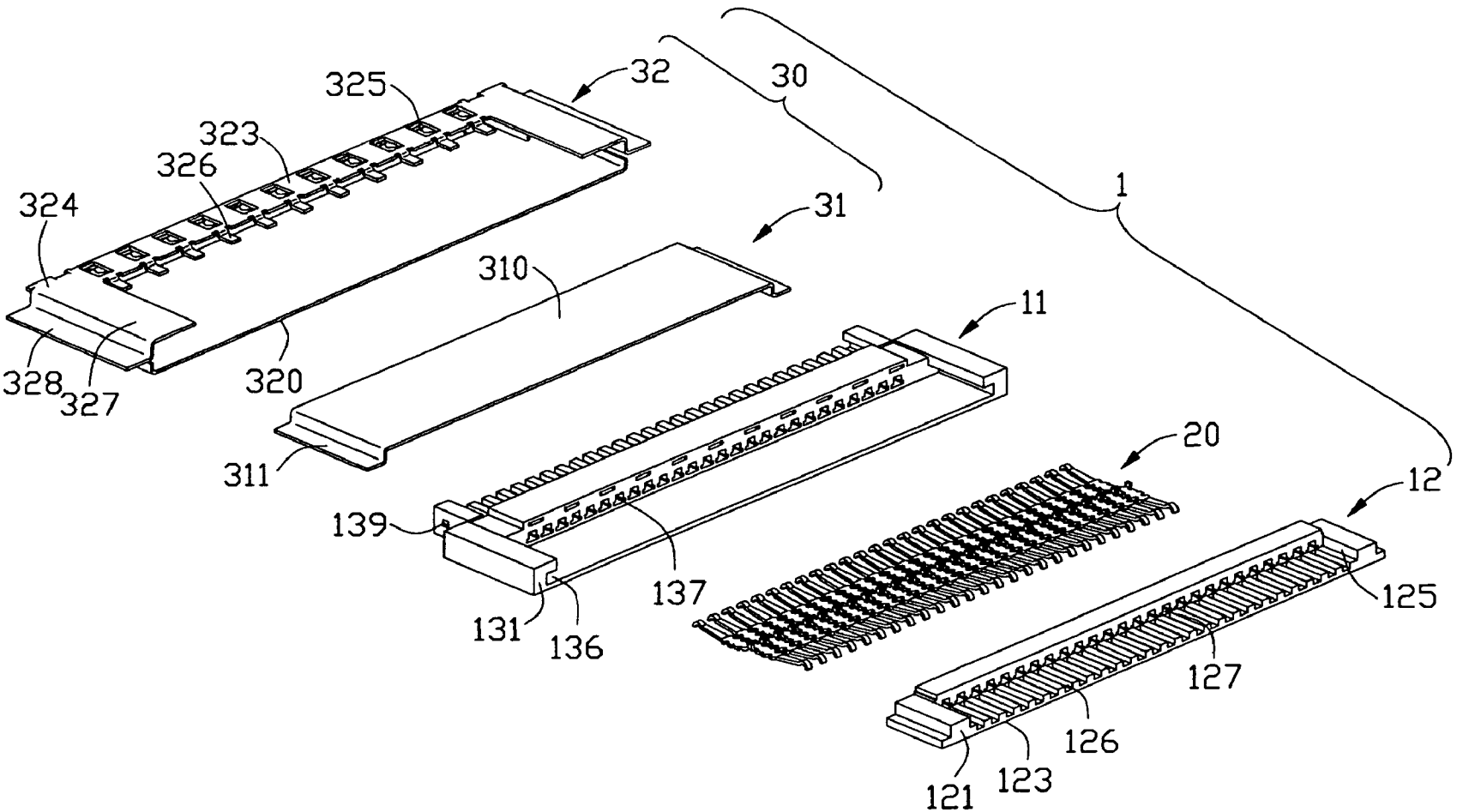
FIG. 5 is an exploded perspective view of the electrical connector of FIG. 3.

Referring to FIGS. 1 and 5, an electrical connector 1 in accordance with the present invention, a module 4 and a complementary connector 5 both adapted for mating with the electrical connector 1 are disclosed. The electrical connector 1 comprises an insulative housing 10, a plurality of contacts 20, and a shield member 30.

Figure 8:
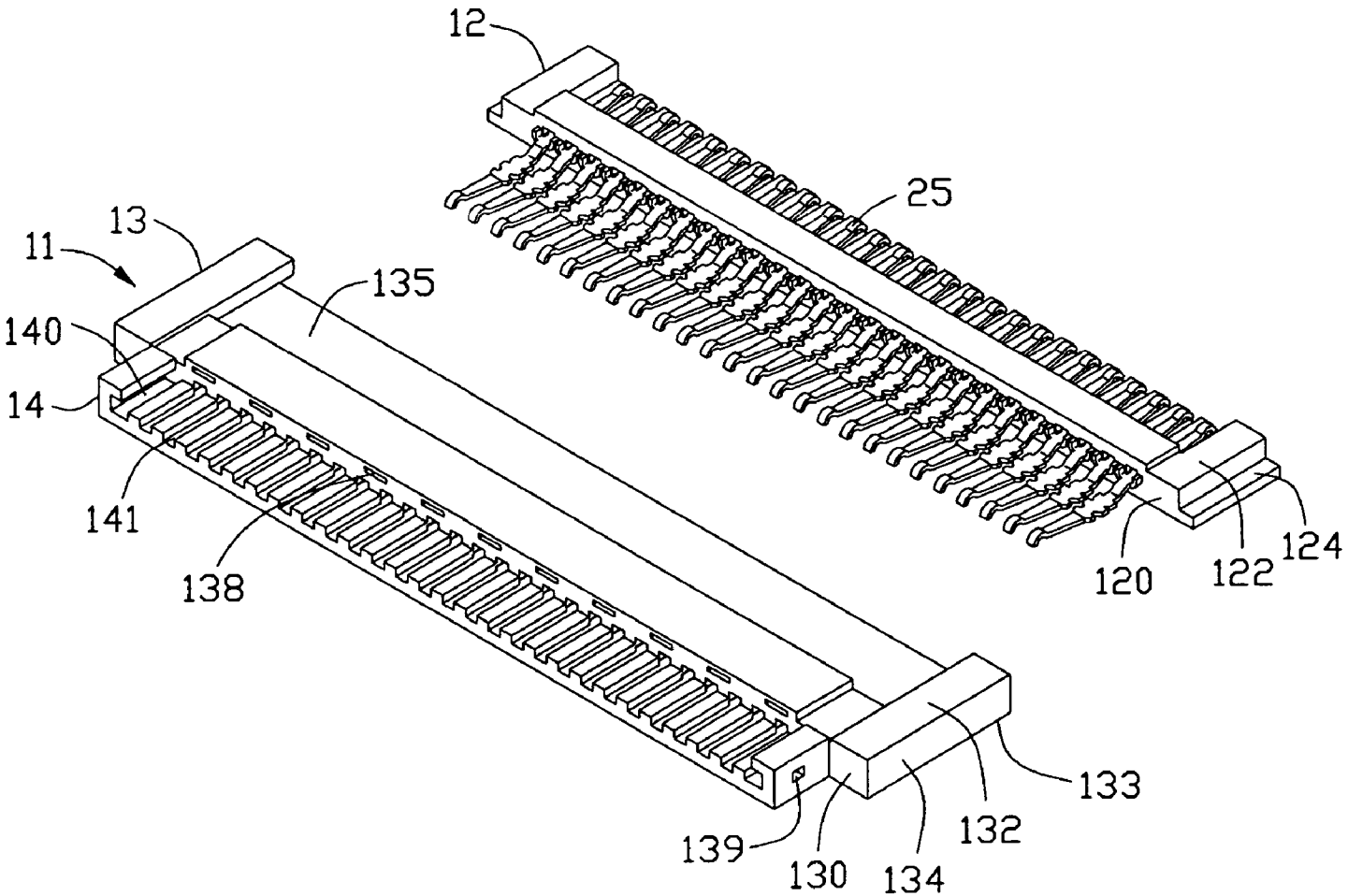
FIG. 8 is an exploded perspective view of an insulative housing of FIG. 5 with contacts attached to a second housing thereof.
Figure 9:
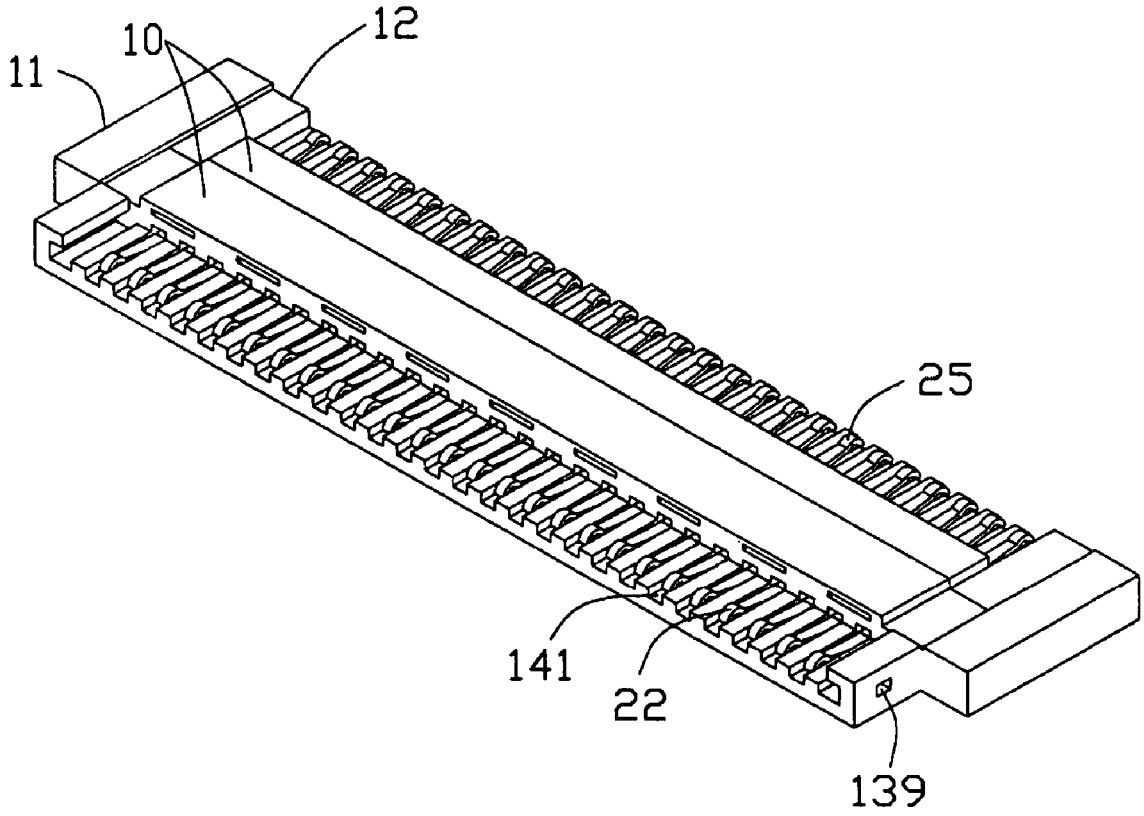
FIG. 9 is an assembled view of the insulative housing of FIG. 8 with the contacts received therein.

Referring to FIGS. 8 and 9 in conjunction with FIG. 5, the insulative housing 10 comprises a first housing 11 and a second housing 12. The first housing 11 comprises an elongated base 13 and a mating portion 14. The base 13 has a front face 130, a rear face 131 opposite to the front face 130, an upper face 132, a lower face 133 opposite to the upper face 132, and two opposite end faces 134. The base 13 defines a cavity 135 in the upper face 132 thereof extending through the rear face 131. A pair of slots 136 are defined in opposite ends of the base 13 and in communication with the cavity 135. The mating portion 14 extends forwardly from the front face 130 of the base 13 and defines a front mating port 140. A plurality of first passageways 141 are defined in a lower side of the mating port 140. The first passageways 141 extend rearwardly into the base 13 to form a plurality of first apertures 137 therein. A pair of latch holes 139 are defined on opposite ends of the mating portion 14. The first apertures 137 communicate with the cavity 135. A plurality of engaging hole 138 are defined in the front face 130 of the base 13.

The second housing 12 is elongated and has a front face 120, a rear face 121 opposite to the front face 120, an upper face 122, a lower face 123 opposite to the upper face 122. A pair of guiding portions 124 are formed on opposite ends of the second housing 12. The second housing 12 defines a rear mating port 125 in the upper face 122 and adjacent to the rear face 121 and a plurality of second passageways 126 communicating with the rear mating port 125. The second housing 12 defines a plurality of second apertures 127 at a front side of the rear mating port 125 and each aligned with a corresponding second passageway 126. The second apertures 127 extend forwardly throughout the front face 120.

Figure 6:
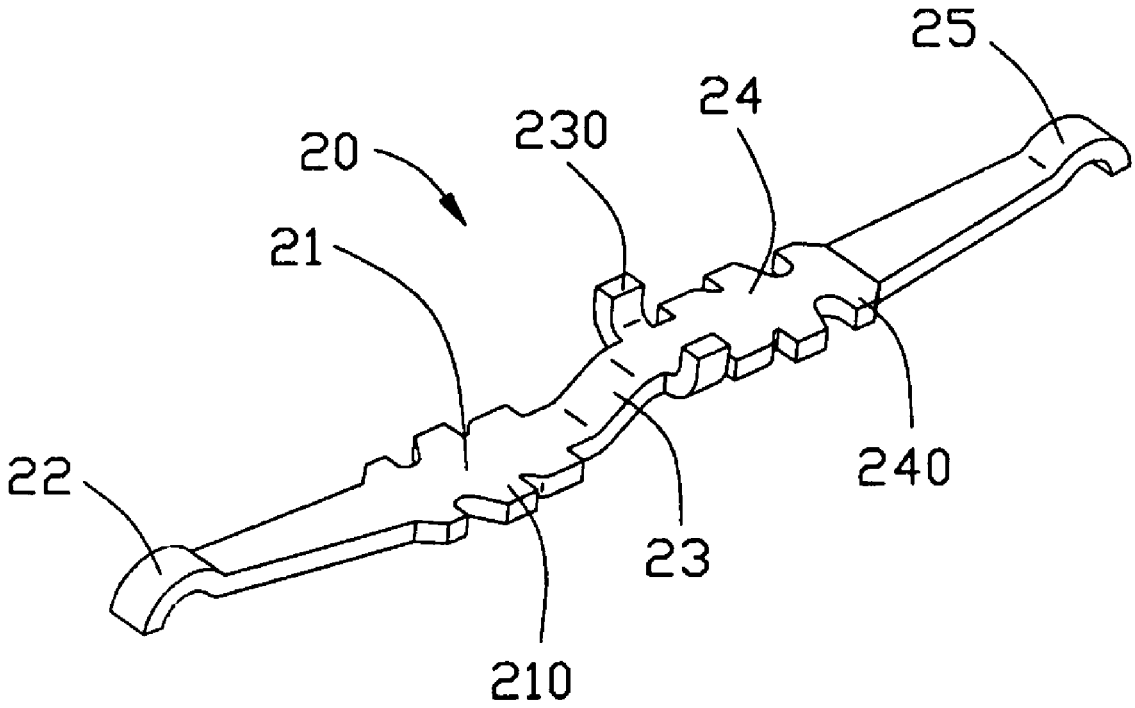
FIG. 6 is an enlarged perspective view of a contact of FIG. 5.

Referring to FIG. 6, each of the contacts 20 comprises a first retention portion 21, a front contact portion 22 extending forwardly from the first retention portion 21, a transitional portion 23 extending rearwardly from the first retention portion 21, a second retention portion 24 extending rearwardly from the transitional portion 23, and a rear contact portion 25 extending rearwardly from the second retention portion 24. The first and the second retention portions 21, 24 are respectively formed with a plurality of barbs 210, 240 on opposite sides thereof. A pair of protrusions 230 are formed on opposite sides of the transitional portions 23.

Figure 7:
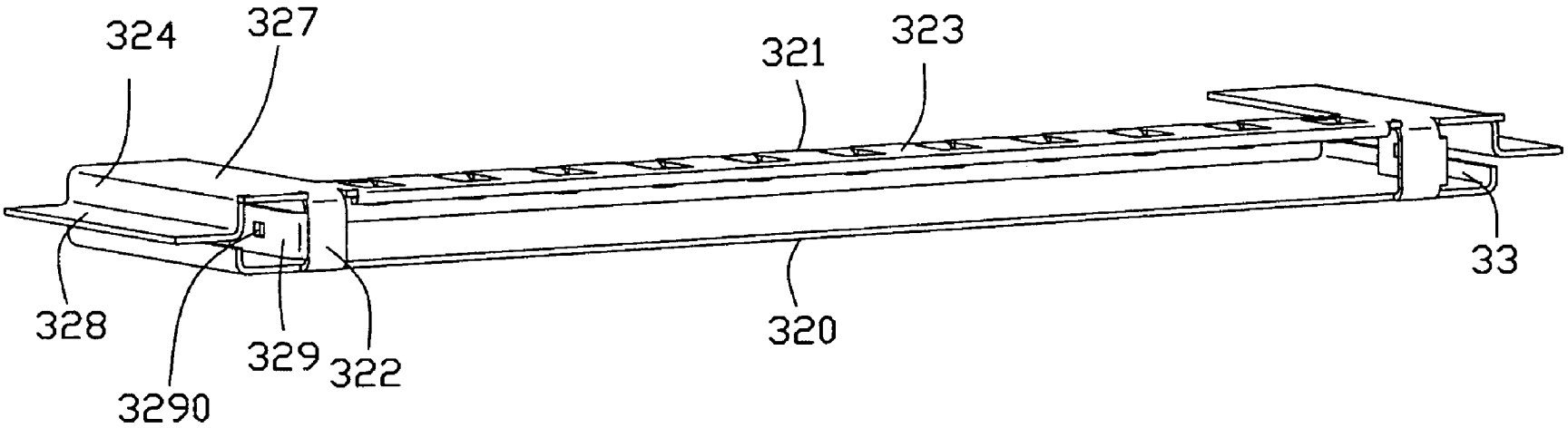
FIG. 7 is an enlarged perspective view of a lower shell of FIG. 5.

Referring to FIGS. 5 and 7, the shield member 30 comprises an upper shell 31 and a lower shell 32 stamped from a metal plate, respectively. The upper shell 31 comprises a main plate 310 and a pair of retention plates 311 downwardly laterally bent from opposite ends of the main plate 310. The lower shell 32 comprises a lower wall 320, an upper wall 321 and a pair of connect portions 322 connecting with the lower wall 320 and the upper wall 321. Opposite ends of the lower wall 320 are bent upwardly. The upper wall 321 comprises a middle portion 323 and two opposite end portions 324. A plurality of spring tabs 325 are downwardly stamped from the middle portion 321. A front edge of the middle portion 323 bends downwardly and rearwardly to function as a guiding portion for mating with the complementary connector 5. A plurality of latch tabs 326 extend rearwardly from a rear edge of the middle portion 323. Each of the end portions 324 comprises a body portion 327 and a solder portion 328 downwardly laterally bent from an outer side of the body portion 327. The connect portions 322 extend upwardly from a front edge of the lower wall 320 adjacent opposite ends thereof. Each of the connect portions 322 comprises a side plate 329 extending rearwardly between the lower wall 320 and the upper wall 321. A pair of receiving spaces 33 are formed between the side plates 329, the opposite ends of the lower wall 320 and the body portions 327. The side plate 329 defines an opening 3290 corresponding to a corresponding latch hole 139 of the first housing 11.

Referring to FIGS. 3–4 and 8–9, in assembly, the contacts 20 are assembled to the second housing 12 from the front face 120. The second retention portions 24 of the contacts 20 are inserted into the second apertures 127 of the second housing 12 with the barbs 240 engaging with inner sides of the second apertures 127. The second contact portions 25 of the contacts 20 are received in the second passageways 126 of the second housing 12 and exposed into the rear mating port 125 of the second housing 12. The protrusions 230 abut against the front face 120 of the second housing 12, which facilitates insertion of the contacts 20 into the second housing 12. The second housing 12 with the contacts 20 is then inserted into the cavity 135 of the first housing 11 by the guiding portions 124 of the second housing 12 received in the slots 136 of the first housing 11. The first retention portions 21 and the transitional portions 23 are received in the first apertures 137 of the first housing 11 with the barbs 210 and the protrusions 230 engaging with inner sides of the first apertures 137. The first contact portions 22 are received in the first passageways 141 of the first housing 11 and exposed into front mating port 140 of the first housing 11. The first passageways 141 of the first housing 11 align with the second passageways 126 in a front-to-rear direction. The first contact portions 22 of the contacts 20 are arranged in a first mating plane and the second contact portions 25 are arranged in a second mating plane. The first mating plane is lower than the second mating plane. The upper shell 31 covers the upper faces 132, 122 of the base 13 and the second housing 12. The lower shell 32 is assembled to the first housing 11 from a front side thereof with the latch tabs 326 inserted into the engaging holes 138 of the first housing 11. The bent opposite ends of the lower wall 320 abut against the end faces 134 of the base 13. The connect portion 322 covers opposite ends of the mating portion 14 with the opening 3290 corresponding to the latch holes 139. The middle portion 323 of the upper wall 321 covers the front mating port 140 of the mating portion 14 with the spring tabs 325 extending into the mating port 140. The end portions 324 of the upper wall 321 cover opposite ends of the base 13. The retention plates 311 of the upper shell 31 are clamped between the upper face 132 of the base 13 and the body portions 327 of the end portions 324 for securing the upper shell 31 and electrically connecting with the upper and the lower shell 31, 32. The solder portions 328 extend laterally from the end faces 134 of the base 13 of the first housing 11 for soldering to a printed circuit board (not shown) on which the electrical connector 1 is mounted.

Referring to FIG. 1, when the electrical connector 1 is to be mated with the module 4 and the complementary connector 5, a mating plate 40 of the module 4 is inserted into the rare mating port 125 of the electrical connector 1 for electrical connecting with contact pads 41 disposed on the mating plate 40 and the second contact portions 25 of the contacts 20. A mating plate 50 of the complementary connector 5 is inserted into the front mating port 140 of the electrical connector 1 for electrically connecting with terminals 51 disposed on a first side of the mating plate 50. The spring tabs 325 of the electrical connector 1 electrically connect with ground members 52 disposed on a second side opposite to the first side of the mating plate 50. A pair of guiding posts 53 are received in the receiving spaces 33 of the electrical connector 1. A pair of latches 54 attached on the guiding posts 53 lock with the latch holes 139 through the openings 3290 for reliable engagement between the electrical connector 1 and the complementary connector 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an elongated insulative housing defining a mating face with opposite top and bottom faces by two vertical sides thereof, a mating opening being formed in said mating face and defining a mating direction thereof;

a one-piece metallic shell including spaced opposite top and bottom walls at least partially covering said top and bottom faces, respectively;

a pair of connection portions located on said mating face by two sides of said mating opening; and a pair of side plates respectively extending from the corresponding connection portions; wherein each of said side plates defines a locking structure thereon, wherein said shell forms two opposite end portions at two opposite lengthwise ends thereof, said end portions protectively covering the corresponding side plates in a lengthwise direction, respectively;

wherein a passage is formed between each of said end portions and the corresponding side plate so as to receive therein a guiding post and a moveable latch of a complementary connector;

wherein said latch defines thereon another locking structure latchably engageable with said locking structure.

* * * * *